US010993033B2

(12) United States Patent
Spillmann et al.

(10) Patent No.: US 10,993,033 B2
(45) Date of Patent: Apr. 27, 2021

(54) LOUDSPEAKER FRAME HAVING TAPERED SPOKES

(71) Applicant: Harman International Industries, Incorporated, Stamford, CT (US)

(72) Inventors: Jacques Spillmann, Los Angeles, CA (US); Brian Cummins McLaughlin, Pasadena, CA (US); Alexander Voishvillo, Simi Valley, CA (US)

(73) Assignee: Harman International Industries, Incorporated, Stamford, CT (US)

( * ) Notice: Subject to any disclaimer, the term of this patent is extended or adjusted under 35 U.S.C. 154(b) by 31 days.

(21) Appl. No.: 16/556,554

(22) Filed: Aug. 30, 2019

(65) Prior Publication Data

US 2020/0092653 A1 Mar. 19, 2020

Related U.S. Application Data

(60) Provisional application No. 62/731,268, filed on Sep. 14, 2018.

(51) Int. Cl.

| | |
|---|---|
| ***H04R 9/02*** | (2006.01) |
| ***H04R 7/18*** | (2006.01) |
| ***H04R 9/06*** | (2006.01) |
| ***H04R 7/12*** | (2006.01) |

(52) U.S. Cl.

CPC ..... *H04R 9/02* (2013.01); *H04R 7/127* (2013.01); *H04R 7/18* (2013.01); *H04R 9/06* (2013.01); *H04R 2400/11* (2013.01)

(58) Field of Classification Search

CPC ..... H04R 9/06; H04R 9/022; H04R 9/025; H04R 9/043; H04R 9/045; H04R 31/006; H04R 2400/11; H04R 7/20; H04R 1/2834; H04R 7/16; H04R 9/02; H04R 1/025; H04R 7/18; H04R 1/02; H04R 1/06; H04R 2499/13; H04R 7/122; H04R 1/00; H04R 2209/022; H04R 2209/024; H04R 7/06; H04R 9/04; H04R 9/041

See application file for complete search history.

(56) References Cited

U.S. PATENT DOCUMENTS

| | | | | |
|---|---|---|---|---|
| D486,818 | S * | 2/2004 | Shindo | D14/216 |
| D502,939 | S * | 3/2005 | Dayan | D14/216 |
| 7,164,777 | B1 * | 1/2007 | Stompler | H04R 9/06 381/412 |
| D691,595 | S * | 10/2013 | Fuller | D14/224 |
| 2004/0197007 | A1 * | 10/2004 | Onuma | H04R 31/00 381/423 |
| 2005/0169494 | A1 * | 8/2005 | Stiles | H04R 1/02 381/337 |

(Continued)

*Primary Examiner* — Alexander Krzystan
*Assistant Examiner* — Julie X Dang
(74) *Attorney, Agent, or Firm* — Brooks Kushman P.C.

(57) ABSTRACT

A speaker frame, and corresponding speaker, may have tapered spokes that form a radial triangular pattern with an apex converging near the frame's mounting flange, for example, near tabs including mounting holes where the frame attaches to a speaker baffle. The tapered spokes may include a triangular cut-out region defining a pair of converging legs that converge at the mounting flange. The width, curvature, and the angle of the spokes may allow for a thin and lightweight configuration with uniformly distributed minimal stress.

20 Claims, 5 Drawing Sheets

(56) References Cited

U.S. PATENT DOCUMENTS

| | | | | |
|---|---|---|---|---|
| 2005/0185816 | A1* | 8/2005 | Roark | H04R 9/06 381/400 |
| 2006/0171557 | A1* | 8/2006 | Chan | H04R 9/06 381/433 |
| 2007/0025587 | A1* | 2/2007 | Hlibowicki | H04R 9/046 381/412 |
| 2012/0281861 | A1* | 11/2012 | Lin | H04R 7/122 381/182 |
| 2013/0108099 | A1* | 5/2013 | Kemmerer | H04R 9/022 381/397 |
| 2013/0170677 | A1* | 7/2013 | Enomoto | H04R 19/02 381/191 |

* cited by examiner

LOUDSPEAKER FRAME HAVING TAPERED SPOKES

CROSS-REFERENCE TO RELATED APPLICATIONS

This application claims the benefit of U.S. provisional application Ser. No. 62/731,268 filed Sep. 14, 2018, the disclosure of which is hereby incorporated in its entirety by reference herein.

TECHNICAL FIELD

The present disclosure relates to a loudspeaker and a corresponding frame or basket for the loudspeaker, and more specifically to a spoke configuration of the loudspeaker frame.

BACKGROUND

The function of a frame in a direct radiating loudspeaker is to hold the edge of a diaphragm's suspension on one side and hold the attached motor assembly and the moving assembly spider on the other side. The traditional frame configuration uses radially-oriented spokes that connect the base of the frame to the surround landing. Many loudspeaker applications require the minimization of transducer weight, which includes the weight of the frame. Weight reduction must also be balanced with the structural integrity of the frame.

SUMMARY

One or more embodiments of the present disclosure is directed to a frame or basket for a speaker. The frame may comprise a base including a mounting surface for mechanically coupling to a motor assembly of the speaker. The frame may further comprise a mounting flange configured to mount the speaker to a baffle and support a diaphragm assembly. Further, the frame may include a plurality of tapered spokes extending from the base to support the mounting flange. Each tapered spoke may taper from the base in a direction of the mounting flange.

Each tapered spoke may have a convex curvature in relation to a central longitudinal axis of the frame. The plurality of tapered spokes may include four tapered spokes spaced apart by 90 degrees. Alternatively, the plurality of tapered spokes may include three tapered spokes spaced apart by 120 degrees. Each tapered spoke may include a cut-out region defining a pair of converging legs comprising a first converging leg and a second converging leg.

The mounting flange may include a plurality of mounting tabs having a mounting hole. The plurality of mounting tabs may extend outward to provide support for mounting the speaker. Moreover, a quantity of the plurality of mounting tabs may be equal to the quantity of the plurality of tapered spokes.

The first converging leg and the second converging leg in each pair of converging legs may join at the mounting flange adjacent a respective mounting tab. Moreover, each converging leg in the pair of converging legs may be symmetrical with respect to a radial axis extending from the center of the frame through a corresponding mounting hole. An outer edge of each converging leg may be convex with respect to the radial axis.

One or more additional embodiments of the present disclosure is directed to a speaker comprising a diaphragm assembly, a motor assembly for driving the diaphragm assembly, and a frame. The diaphragm assembly may include a diaphragm and a surround. The frame may have a base mechanically coupled to the motor assembly, a mounting flange coupled to the diaphragm via the surround, and a connecting structure extending between the base and the mounting flange. The connecting structure may include a plurality of tapered spokes extending from the base and tapering in a direction of the mounting flange.

Each tapered spoke may define a radial triangular pattern having an apex adjacent the mounting flange. Moreover, each tapered spoke may have a convex curvature in relation to a central longitudinal axis of the frame. The plurality of tapered spokes may include four tapered spokes spaced apart by 90 degrees. Each tapered spoke may include a cut-out region defining a pair of converging legs comprising a first converging leg and a second converging leg.

The mounting flange may include a plurality of mounting tabs having a mounting hole. The plurality of mounting tabs may extend outward to provide support for mounting the speaker. Moreover, a quantity of the plurality of mounting tabs may be equal to the quantity of the plurality of tapered spokes. The first converging leg and the second converging leg in each pair of converging legs may join at the mounting flange adjacent a respective mounting tab.

One or more additional embodiments of the present disclosure is directed to a loudspeaker assembly comprising a baffle and at least one speaker mounted to the baffle. Each speaker may include a diaphragm assembly including a diaphragm and a surround, a motor assembly for driving the diaphragm assembly, and a frame. The frame may have a base mechanically coupled to the motor assembly, a mounting flange coupled to the diaphragm via the surround, and a connecting structure extending between the base and the mounting flange. The connecting structure may include a plurality of tapered spokes extending from the base and tapering in a direction of the mounting flange to form a radial triangular pattern having an apex adjacent the mounting flange.

Each tapered spoke may have a convex curvature in relation to a central longitudinal axis of the frame. The mounting flange may include a plurality of mounting tabs having a mounting hole. The plurality of mounting tabs may extend outward to provide support for mounting the speaker. Moreover, a quantity of the plurality of mounting tabs may be equal to the quantity of the plurality of tapered spokes. Further, each tapered spoke may include a triangular cut-out region defining a pair of converging legs comprising a first converging leg and a second converging leg. The pair of converging legs may converge at the mounting flange adjacent a respective mounting tab.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
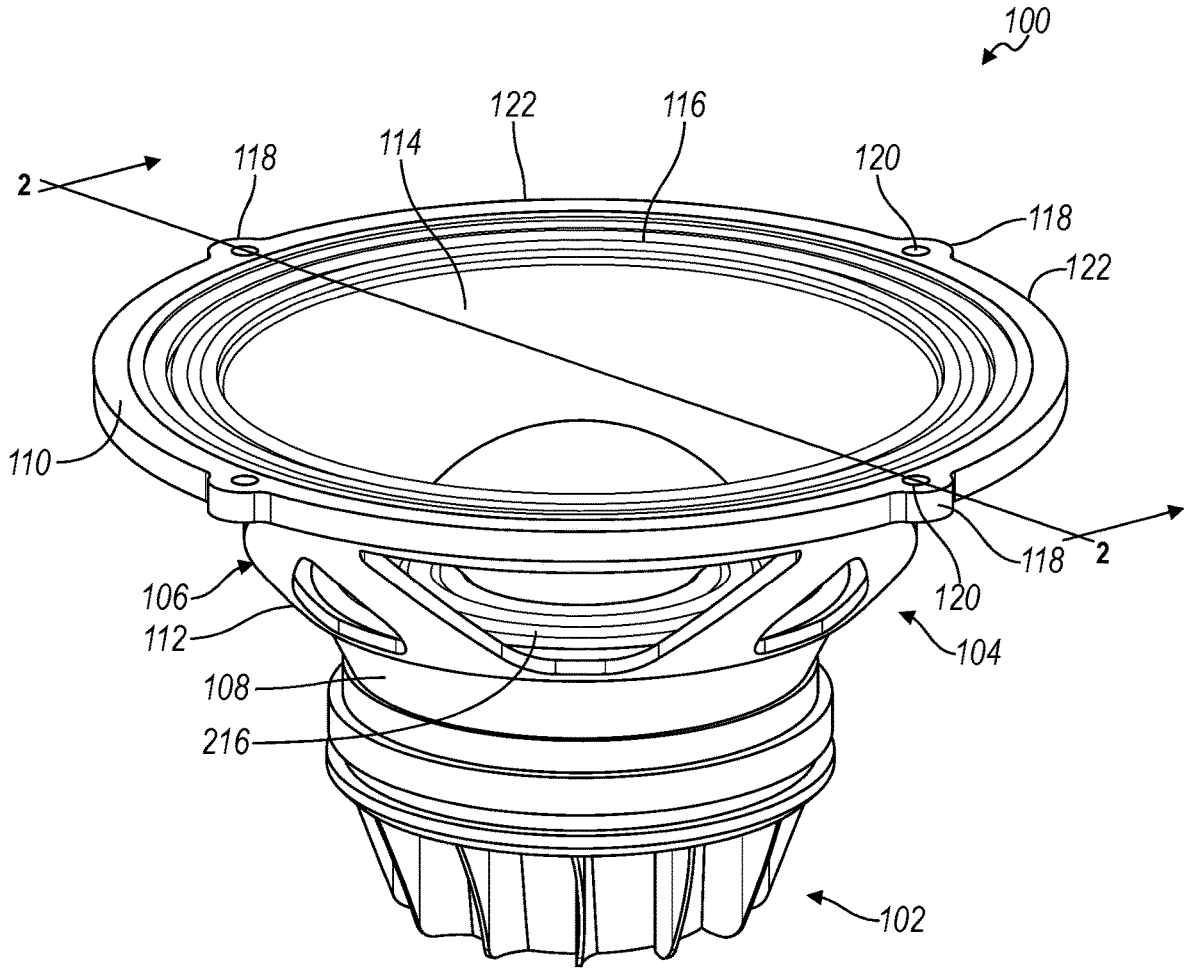
FIG. 1 is perspective view of a speaker having a frame, in accordance with one or more embodiments of the present disclosure.

FIG. 1 is a perspective view illustrating an acoustic transducer or speaker 100 with a magnetic motor assembly 102 driving a diaphragm assembly 104. A frame or basket 106 may be mechanically coupled to the motor assembly 102 to support the diaphragm assembly 104. The frame 106 may include a base 108 for coupling to the motor assembly, a mounting flange 110, and a connecting structure 112 extending generally outward and upward from the base 108 to support the mounting flange 110. A diaphragm 114, sometimes referred to as a cone, may be coupled to the frame 106 at the mounting flange 110 by a flexible suspension component often referred to as a surround 116. The diaphragm assembly 104 may include at least the diaphragm 114 and the surround 116.

The mounting flange 110 may include mounting tabs 118 which extend outward to provide support for mounting the speaker 100 and to provide adequate clearance for mounting holes 120. Accordingly, the speaker 100 may be mounted to a baffle of a loudspeaker assembly (not shown) using appropriate fasteners (e.g., screws) fed through the respective mounting holes 120. The mounting flange 110 may also include non-tab portions 122 which only extend outward enough to form a seal with the baffle (not shown) to which the speaker 100 is mounted.

Figure 2:
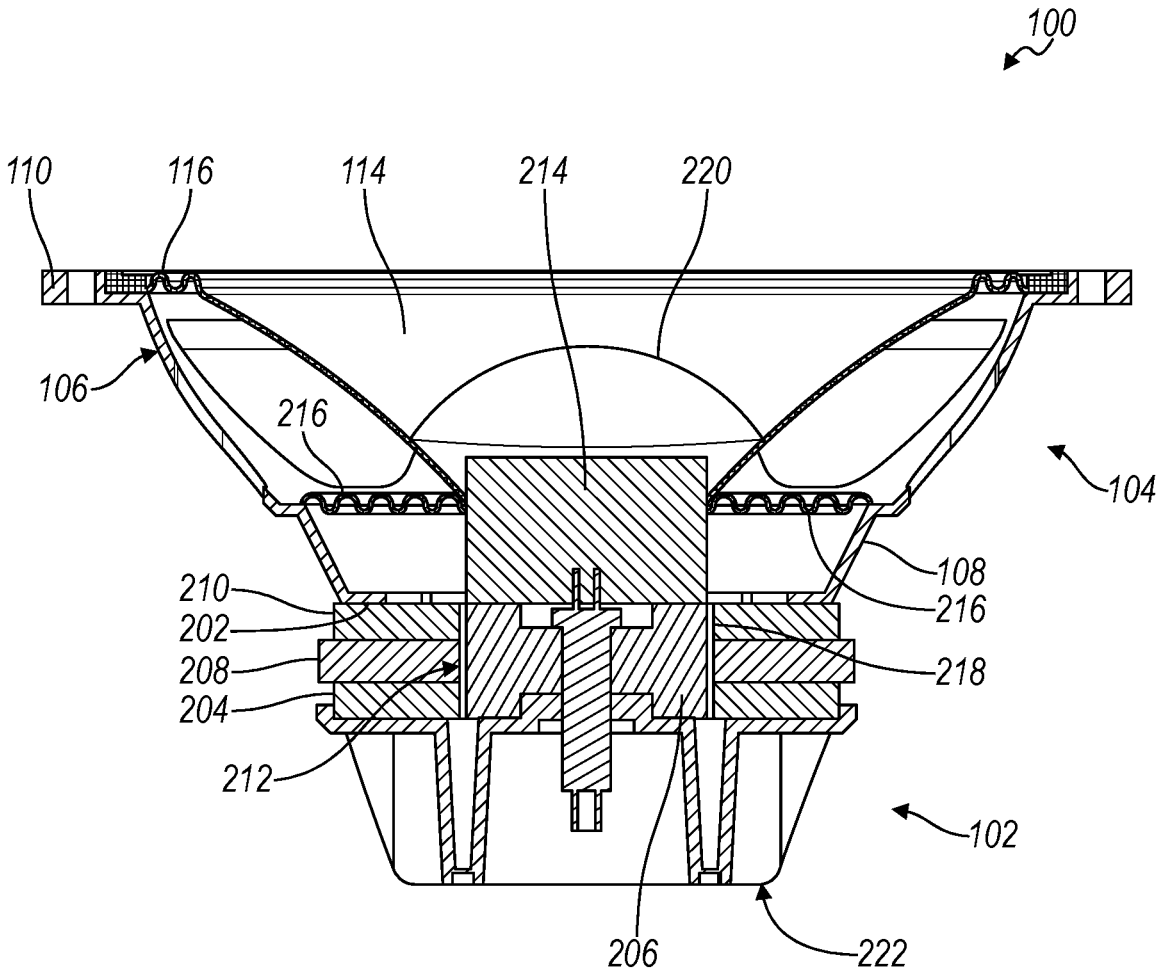
FIG. 2 is a sectional view of the speaker in FIG. 1, in accordance with one or more embodiments of the present disclosure.

FIG. 2 is a section view of the speaker 100 illustrated in FIG. 1 along an axially-extending plane bisecting the speaker 100. Referring to FIG. 2, the base 108 may include a mounting surface 202 for mechanically coupling the motor assembly 102 to the frame 106. The motor assembly 102 may include a back plate 204 and a pole piece 206 that are either magnetically coupled or of integral construction (i.e., pole plate or yoke). One or more external ring hard magnets 208 may be magnetically coupled to the back plate 204. A top plate 210 may be magnetically coupled to the hard magnet 208. A magnetic air gap 212 may be formed between the top plate 210 and the pole piece 206.

A voice coil former or bobbin 214 may be mechanically coupled to the diaphragm 114. The bobbin 214 may be further coupled to the frame 106 by a flexible suspension component referred to as a spider 216 (see also FIG. 1). The surround 116 and spider 216 allow the bobbin 214 and diaphragm 114 to move axially with respect to the motor assembly 102, while simultaneously precluding or significantly minimizing their lateral movement. An electrically conductive voice coil 218 may be wound around, and mechanically coupled to, the bobbin 214. The voice coil 218 may be disposed within the magnetic air gap 212 of the motor assembly 102. A dust cap 220 may be coupled to the diaphragm 114 to seal the open end of the bobbin 214. Further, the back plate 204 and pole piece 206 may be mechanically coupled to a heat sink 222.

Figure 3:
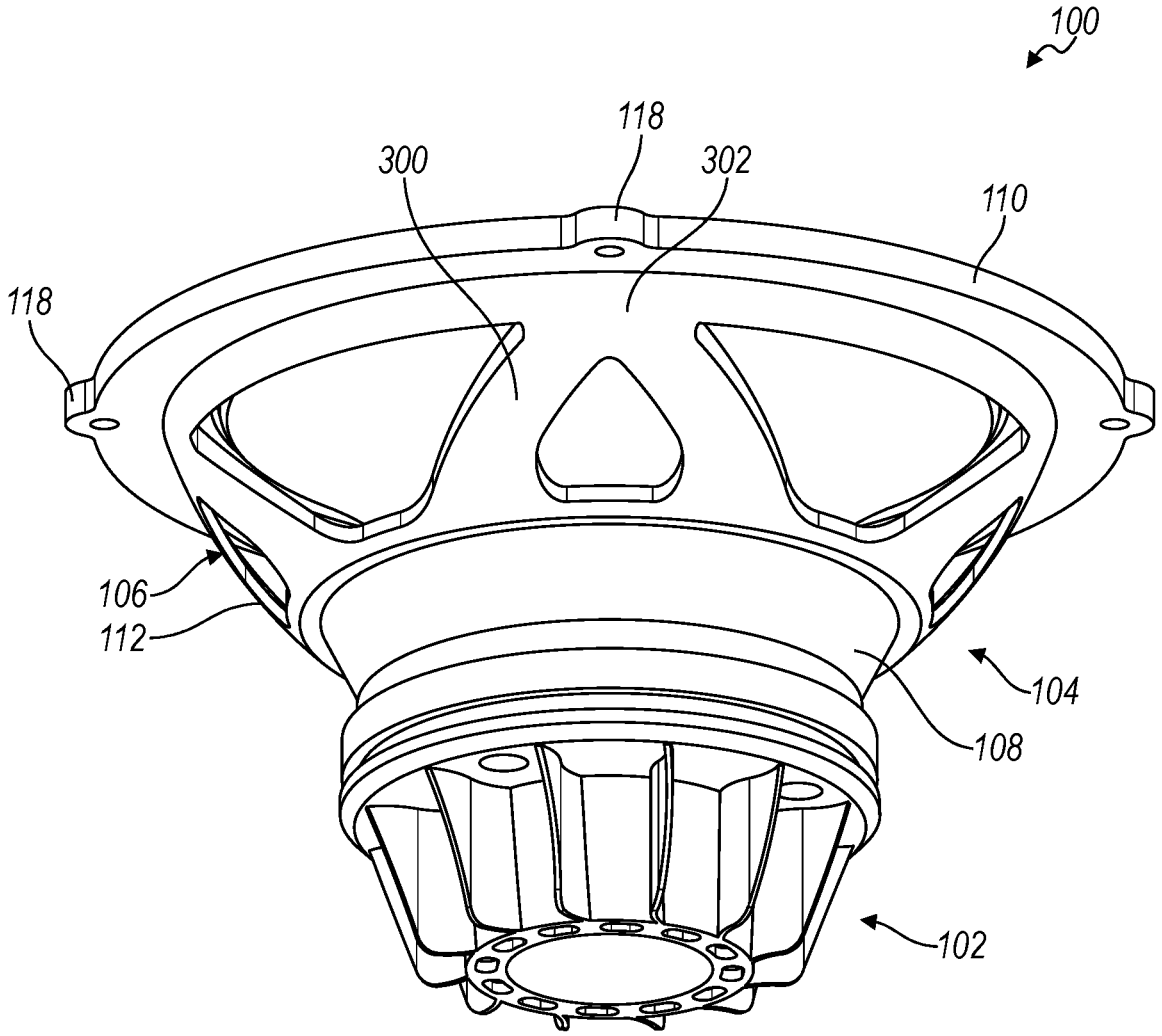
FIG. 3 is another perspective view of the speaker in FIG. 1, in accordance with one or more embodiments of the present disclosure.

FIG. 3 is another perspective view of the speaker 100 showing the connecting structure 112 of the frame 106 in greater detail. As shown, the connecting structure 112 may include a plurality of tapered spokes 300. Each tapered spoke 300 may form a generally radial triangular pattern with an apex 302 converging near the frame's mounting flange 110. According to one or more embodiments, a quantity of the plurality of mounting tabs may be equal to the quantity of the plurality of tapered spokes. The frame 106, including the connecting structure 112, is illustrated in greater detail in FIGS. 4 and 5.

Figure 4:
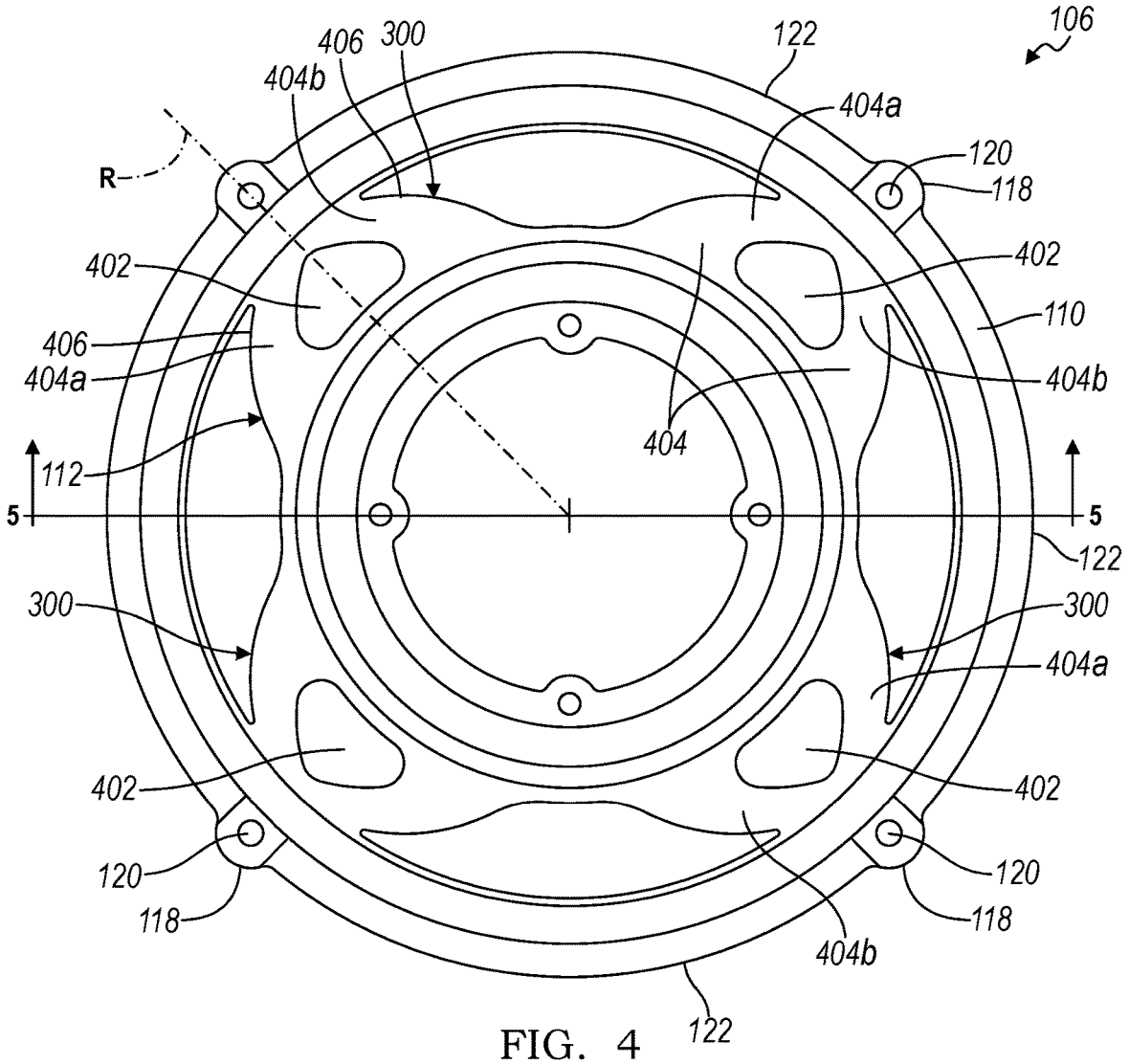
FIG. 4 is a top view of a frame for a speaker, in accordance with one or more embodiments of the present disclosure.
Figure 5:
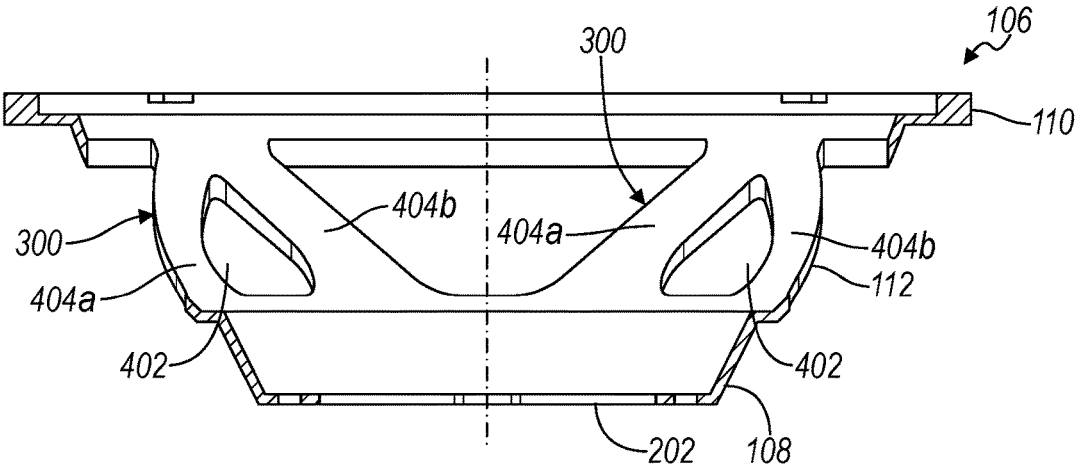
FIG. 5 is a sectional view of the frame in FIG. 4, in accordance with one or more embodiments of the present disclosure.

FIG. 4 is a top view of the frame 106, in accordance with one or more embodiments of the present disclosure. Meanwhile, FIG. 5 is a sectional view of the frame 106 along line 5-5 in FIG. 4. As shown, the connecting structure 112 may comprise a plurality of tapered spokes 300 extending generally outward and upward from the base 108 to support the mounting flange 110. Each spoke 300 may include a cut-out region 402 defining a pair of converging legs 404. According to one or more embodiments, the cut-out region 402 may be generally triangular. Each pair of converging legs 404 may generally comprises a first converging leg 404*a* and a second converging leg 404*b*. Accordingly, each spoke 300 may taper from the base 108 toward (in a direction of) the mounting flange 110 such that the pair of converging legs 404 join at or near the mounting flange 110 (e.g., approximate the apex 302). Each triangular cut-out region 402 may be defined by rounded corners. Moreover, the converging legs 404*a* and 404*b* in each pair of converging legs 404 may join or converge near a respective mounting tab 118 that includes the mounting holes 120 where the frame 106 attaches to a speaker baffle.

As shown, the tapered spokes 300 may have a generally triangular or trapezoidal shape in that the width of the spoke at the base 108 of the frame 106 is greater than the width of the spoke at the mounting flange 110. The width, curvature, and the angle of the tapered spokes 300 may allow for a thin and lightweight configuration with uniformly distributed minimal stress. The cut-out region 402 in each tapered spoke 300 may reduce excess weight in the frame 106 without sacrificing its structural integrity. Each converging leg 404*a,b* in the pair of converging legs 404 may be symmetrical about a radial axis R extending from the center X of the frame 106 through the mounting holes 120. Moreover, the converging legs 404*a* and 404*b* may gently arc as each pair converges near the mounting flange 110. For instance, an outer edge 406 of each converging leg 404*a,b* with respect to the radial axis R may be rounded or convex. Further, each tapered spoke 300 may, in general, have a slightly convex curvature in relation to a central longitudinal axis L of the frame 106.

As shown in FIG. 4, the frame 106 may include four tapered spokes 300. The tapered spokes 300 may be equally distributed throughout the connecting structure 112 of the frame 106. For instance, adjacent tapered spokes 300 may be spaced apart from each other by approximately 90 degrees. In accordance with one ore more additional embodiments of the present disclosure, the connecting structure 112 of the frame 106 may include fewer or greater than four tapered spokes 300. For example, the connecting structure 112 of the frame 106 may comprise three tapered spokes spaced approximately 120 degrees apart (not shown).

Figure 6:
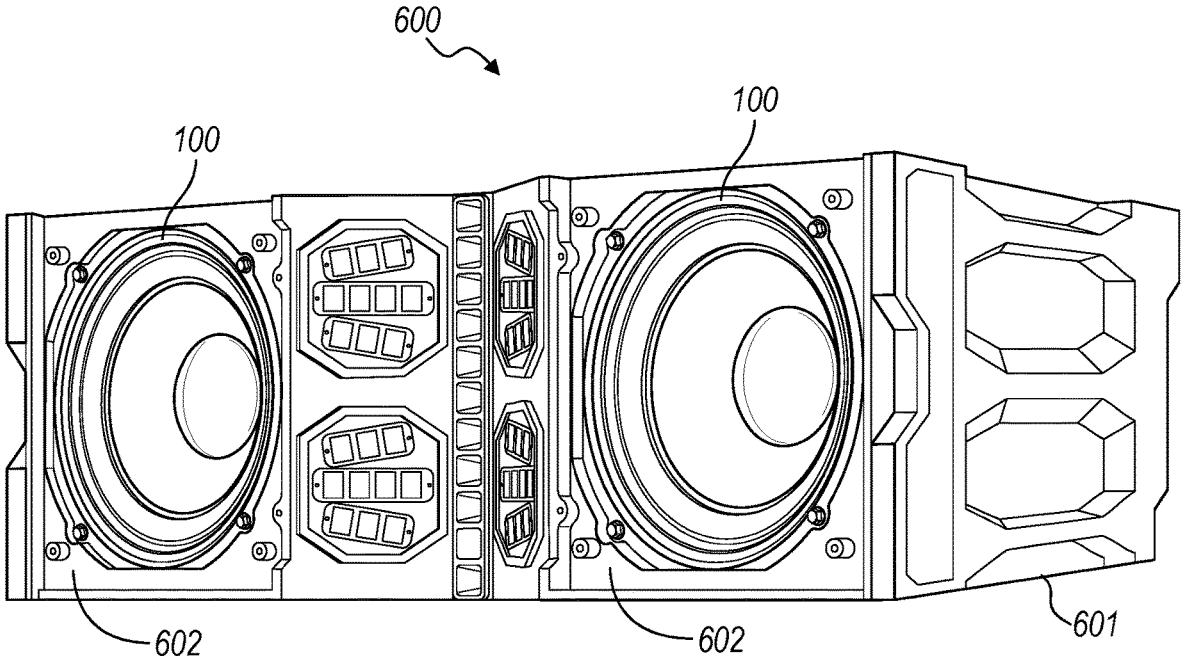
FIG. 6 is a perspective view of a loudspeaker assembly, in accordance with one or more embodiments of the present disclosure.

Referring to FIG. 6, a loudspeaker assembly 600 may include a loudspeaker enclosure 601 and at least one speaker 100, having the above-described frame (not shown), mounted to a baffle 602. The loudspeaker assembly 600 may be a line array system, as shown. Alternatively, the speaker 100 of the present disclosure may be employed in other types of loudspeaker systems.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A frame for a speaker comprising:

a base including a mounting surface for mechanically coupling to a motor assembly of the speaker;

a mounting flange configured to mount the speaker to a baffle and support a diaphragm assembly; and a plurality of tapered spokes extending from the base to support the mounting flange, each tapered spoke tapering from the base in a direction of the mounting flange;

wherein each tapered spoke includes a cut-out region defining a pair of converging legs comprising a first converging leg and a second converging leg.

2. The frame of claim 1, wherein each tapered spoke has a convex curvature in relation to a central longitudinal axis of the frame.

3. The frame of claim 1, wherein the plurality of tapered spokes includes four tapered spokes spaced apart by 90 degrees.

4. The frame of claim 1, wherein the plurality of tapered spokes includes three tapered spokes spaced apart by 120 degrees.

5. The frame of claim 1, wherein each converging leg in the pair of converging legs converges near the mounting flange to define each tapered spoke.

6. The frame of claim 5, wherein the mounting flange includes a plurality of mounting tabs having a mounting hole, the plurality of mounting tabs extending outward to provide support for mounting the speaker, a quantity of the plurality of mounting tabs being equal to the quantity of the plurality of tapered spokes.

7. The frame of claim 6, wherein the first converging leg and the second converging leg in each pair of converging legs join at the mounting flange adjacent a respective mounting tab.

8. The frame of claim 6, wherein each converging leg in the pair of converging legs is symmetrical with respect to a radial axis extending from the center of the frame through a corresponding mounting hole.

9. The frame of claim 8, wherein the cut-out region is triangular.

10. A speaker comprising:

a diaphragm assembly including a diaphragm and a surround;

a motor assembly for driving the diaphragm assembly; and a frame having a base mechanically coupled to the motor assembly, a mounting flange coupled to the diaphragm via the surround, and a connecting structure extending between the base and the mounting flange, the connecting structure including a plurality of tapered spokes extending from the base and tapering in a direction of the mounting flange;

wherein each tapered spoke includes a cut-out region defining a pair of converging legs comprising a first converging leg and a second converging leg that converge at the mounting flange.

11. The speaker of claim 10, wherein each tapered spoke defines a radial triangular pattern having an apex adjacent the mounting flange.

12. The speaker of claim 10, wherein each tapered spoke has a convex curvature in relation to a central longitudinal axis of the frame.

13. The speaker of claim 10, wherein the plurality of tapered spokes includes four tapered spokes spaced apart by 90 degrees.

14. The speaker of claim 11, wherein the cut-out region is triangular.

15. The speaker of claim 14, wherein the mounting flange includes a plurality of mounting tabs having a mounting hole, the plurality of mounting tabs extending outward to provide support for mounting the speaker, a quantity of the plurality of mounting tabs being equal to the quantity of the plurality of tapered spokes.

16. The frame of claim 15, wherein the first converging leg and the second converging leg in each pair of converging legs join at the mounting flange adjacent a respective mounting tab.

17. A loudspeaker assembly comprising:

a baffle; and at least one speaker mounted to the baffle, each speaker including:

a diaphragm assembly including a diaphragm and a surround;

a motor assembly for driving the diaphragm assembly; and a frame having a base mechanically coupled to the motor assembly, a mounting flange coupled to the diaphragm via the surround, and a connecting structure extending between the base and the mounting flange;

wherein the connecting structure includes a plurality of tapered spokes extending from the base and tapering in a direction of the mounting flange to form a radial triangular pattern having an apex adjacent the mounting flange, each tapered spoke including a triangular cut-out region defining a pair of converging legs comprising a first converging leg and a second converging leg.

18. The loudspeaker assembly of claim 17, wherein each tapered spoke has a convex curvature in relation to a central longitudinal axis of the frame.

19. The loudspeaker assembly of claim 17, wherein the mounting flange includes a plurality of mounting tabs having a mounting hole, the plurality of mounting tabs extending outward to provide support for mounting the speaker, a quantity of the plurality of mounting tabs being equal to the quantity of the plurality of tapered spokes.

20. The loudspeaker assembly of claim 19, wherein the pair of converging legs converge at the mounting flange adjacent a respective mounting tab.

* * * * *